US007358686B2

(12) United States Patent
Deurloo

(10) Patent No.: US 7,358,686 B2
(45) Date of Patent: Apr. 15, 2008

(54) METHOD AND DEVICE FOR DRIVING A GAS DISCHARGE LAMP

(75) Inventor: Oscar Jan Deurloo, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 159 days.

(21) Appl. No.: 10/496,708

(22) PCT Filed: Nov. 14, 2002

(86) PCT No.: PCT/IB02/04802

§ 371 (c)(1),
(2), (4) Date: Nov. 8, 2004

(87) PCT Pub. No.: WO03/047321

PCT Pub. Date: Jun. 5, 2003

(65) Prior Publication Data

US 2005/0162103 A1 Jul. 28, 2005

(30) Foreign Application Priority Data

Nov. 30, 2001 (EP) ..... 01204621

(51) Int. Cl.
*H05B 37/02* (2006.01)

(52) U.S. Cl. ..... 315/291; 315/224; 315/DIG. 4

(58) Field of Classification Search ..... 315/307–308, 315/209, 291, 56, 244, DIG. 4, 209 R, 224; 361/93.1, 93.7

See application file for complete search history.

(56) References Cited

U.S. PATENT DOCUMENTS 4,170,747 A 10/1979 Holmes ..... 315/307
4,277,728 A * 7/1981 Stevens ..... 315/307
4,414,493 A * 11/1983 Henrich ..... 315/308
4,728,866 A * 3/1988 Capewell et al. ..... 315/224
4,870,327 A * 9/1989 Jorgensen ..... 315/307
4,958,108 A * 9/1990 Jorgensen ..... 315/307
5,144,205 A 9/1992 Motto et al. ..... 315/244
5,235,255 A * 8/1993 Blom ..... 315/224
5,371,440 A * 12/1994 Liu et al. ..... 315/209 R
5,534,755 A * 7/1996 Deavenport et al. ..... 315/307
5,806,055 A * 9/1998 Zinda, Jr. ..... 706/45
5,959,410 A * 9/1999 Yamauchi et al. ..... 315/209 R
6,072,679 A * 6/2000 Myong ..... 361/93.7
6,175,200 B1 * 1/2001 Kern ..... 315/307
6,222,325 B1 * 4/2001 Wuidart et al. ..... 315/209 R
6,288,501 B1 * 9/2001 Nakamura et al. ..... 315/307
6,504,323 B2 * 1/2003 Yuda et al. ..... 315/307
2002/0033668 A1 * 3/2002 Xihu ..... 313/570
2002/0101183 A1 * 8/2002 Bens et al. ..... 315/224
2003/0038602 A1 * 2/2003 Lestician ..... 315/224
2003/0057876 A1 * 3/2003 Muto ..... 315/246
2005/0035729 A1 * 2/2005 Lev et al. ..... 315/291
2005/0116663 A1 * 6/2005 Van Casteren ..... 315/291

* cited by examiner

*Primary Examiner*—Thuy V. Tran
*Assistant Examiner*—Tung X Le

(57) ABSTRACT

A method for dimming a gas discharge lamp, such as an HID lamp including an MH lamp, includes operating the lamp at nominal power with commutating DC current having a current magnitude $I_L=\alpha I_{nom}$, $\alpha$ being equal to 1 or less than 1. The current magnitude $I_L$ is reduced, but the lamp still is operated at commutating DC current, until $\alpha$ reaches a predetermined value $\beta$. Then, the lamp is operated at DC current, and the current magnitude is reduced further, thus achieving a lower dimming level.

7 Claims, 4 Drawing Sheets

METHOD AND DEVICE FOR DRIVING A GAS DISCHARGE LAMP

Figure 1A:
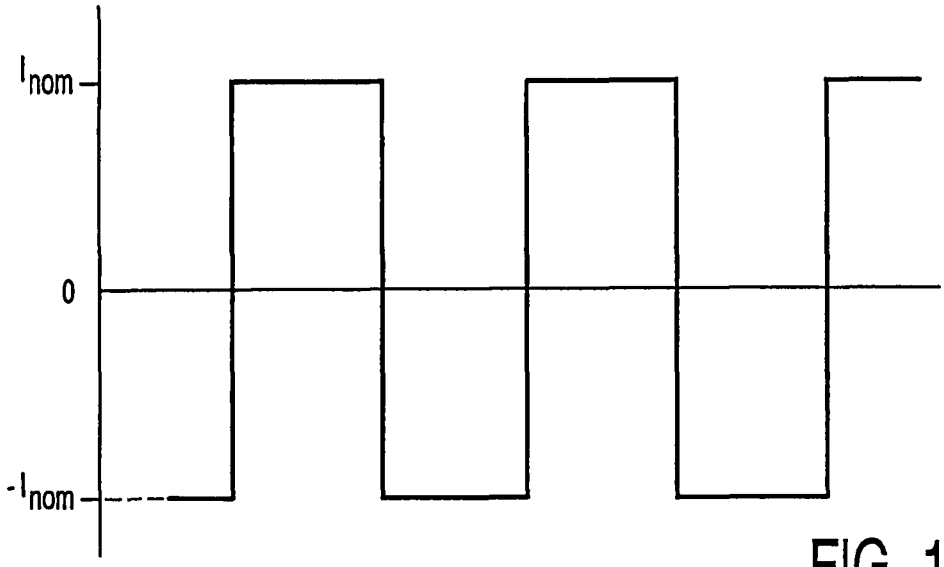

This Application is a National Phase Application under 35 USC 371 claiming the benefit of PCT/IB02/04802 filed on Nov. 14, 2002, which has priority based on European Patent Office (EPO) Application No. 01204621.5 filed on Nov. 30, 2001.

The present invention relates in general to a method and a device for driving a gas discharge lamp, specifically a HID lamp, more specifically a metal halide lamp. More particularly, the present invention relates to dimming such a lamp.

Gas discharge lamps are commonly known. In general, they comprise a light transmitting vessel enclosing a discharge space in a gastight manner, an ionizable filling and a pair of electrodes in the discharge space, each electrode being connected to an associated current conductor which extends from the discharge space through the lamp vessel to the exterior. During operation, a voltage is applied across said electrodes, and a gas discharge occurs between said electrodes causing a lamp current to flow between the electrodes. Although it is possible to drive an individual lamp within a relatively wide range of operating voltages and/or currents, a lamp is typically designed to be operated at a specific lamp voltage and lamp current and thus to have a specific nominal power consumption. At this nominal power, the lamp will generate a nominal amount of light. Since HID lamps are commonly known to persons skilled in the art, it is not necessary to discuss their construction and operation here in more detail.

Generally speaking, it is desirable for a lamp to be dimmable, i.e. the lamp can be operated at a power below the nominal power, such that the lamp will generate less light than the nominal light output. For low-pressure gas discharge lamps, it is for instance known to operate the lamps with AC current and dim a lamp by applying the lamp voltage only during a reduced phase of the lamp period, for instance by a proper phase control of a triac switch in series with the lamp. This means that the lamp receives a lamp voltage only during part of the voltage period, while no lamp current flows during the remaining part of this voltage period. The required amount of dimming is obtained by selecting the ratio between the current-on time and the current-off time. However, such type of dimming is not possible in HID lamps, because this type of lamp has problems recovering from a current-off period.

While a low-pressure gas discharge lamp is typically operated with resonant current, i.e. current having a sine-shaped waveform, a high-pressure discharge lamp is typically operated by supplying commutating DC current. An electronic ballast or driver for such a lamp typically comprises an input for receiving AC mains power, a rectifier for rectifying the AC mains voltage to a rectified DC voltage, a DC/DC upconverter for converting the rectified mains DC voltage to a higher DC voltage, a downconverter for converting said higher DC voltage to a lower DC voltage (lamp voltage) and a higher DC current (lamp current), and a commutator for regularly changing the direction of this DC current. The downconverter behaves like a controlled constant current source, also known as controlled constant current generator. Typically, the commutator operates at a frequency in the order of about 100 Hz. Therefore, in principle, the lamp is operated at a constant current magnitude, the lamp current regularly changing its direction within a very brief time (commutating periods). This mode of operation will be indicated as square-wave current operation.

In a HID lamp, dimming based on phase-cutting the lamp current leads to, for example, reignition problems. Therefore, this type of lamps can be dimmed more readily by decreasing the lamp current to a level below the nominal current. In practice, it is already known to dim HID lamps by decreasing the lamp current to a value below the nominal current.

However, reducing the lamp current in a HID lamp causes problems typically associated with HID lamps, and it is simply not possible to reduce the lamp current unlimitedly. In typical low-pressure fluorescent lamps, the lamp electrodes can be heated separately by electrode current. However, this is not possible in HID lamps. In HID lamps, the lamp electrodes are heated by lamp current, and if the lamp current is reduced, the lamp electrodes cool down and do not function properly anymore. This lamp behavior, more particularly this electrode behavior, results in a practical limitation of the dimming capabilities of a HID lamp. If the dimming level is defined as the ratio between dimmed operating power and nominal lamp power, it is difficult to achieve reliable dimming levels of 50% or more, whereas a low-pressure gas discharge lamp such as a commonly known fluorescent lamp can easily be operated at a dimmed level of 10% or lower.

The above applies especially to metal halide lamps, which form a special family within the generic type of HID lamps. In fact, some manufacturers do not allow their lamps to be dimmed while others discourage it or prescribe a limit of 50% to the dimming level.

The present invention is based on a better understanding of the behavior of HID lamps.

Under normal or nominal operating conditions, lamp electrodes operate in a so-called diffuse mode during their cathode phase. When current is reduced from nominal current to a lower current level, the lamp electrodes change to a so-called spot mode, involving a very hot local spot on the electrode during their cathode phase. When the current is decreased still further, the lamp electrodes change to a glow mode and lamp operation changes to a glow discharge, which is undesirable for steady-state operation.

A HID lamp is designed for optimal operation in the diffuse mode. Operation in the glow discharge mode is undesirable because sputtering occurs, while the lamp generates little or no light. The spot mode would in principle be acceptable, but it appears that the spot cools down very fast. In combination with current interruptions, this can lead to the lamp going out.

The present invention is based on the recognition that the spot mode is in fact relatively stable as long as it is not interrupted. Normally, as mentioned above, a HID lamp is operated with square-wave current, which means that the lamp current is repeatedly changed in direction. This means that, during a current period, an electrode is operated as a cathode during 50% of the current period and as an anode during the other 50% of the current period. Thus, the spot-mode operation of an electrode is interrupted when the current direction changes. It has been found that the lamp goes out because at the end of an anode period and at the beginning of a new cathode period, the electrode apparently is not capable of returning into the spot mode. However, it has also been found that the spot mode is relatively stable as long as the cathode operation of the electrode continues.

Based on this recognition, the present invention proposes to switch to DC operation at reduced current levels.

Indeed, it has been found that, when a HID lamp is operated with DC current, the current level can be reduced much further before the lamp goes out. This can be attributed to the stability of the spot mode, which apparently remains stable when the lamp current is lowered, as long as one electrode is continuously being used as a cathode.

A further advantage resides in that the reduction in light output caused by aging can be decreased when a HID lamp is operated with dimmed DC current.

Figure 1B:
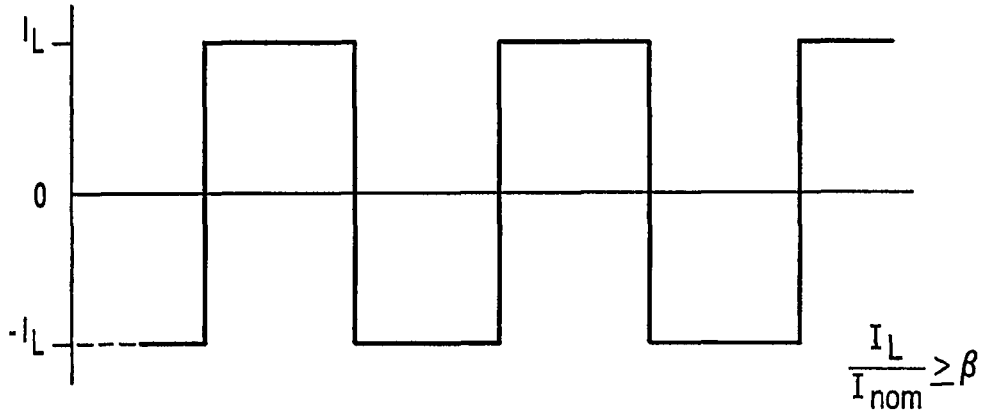
Figure 1C:
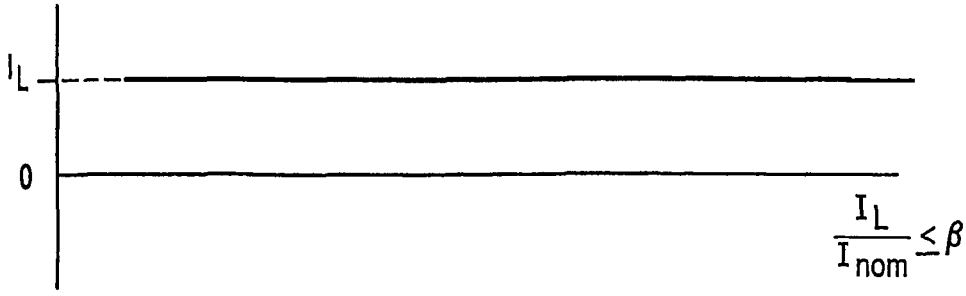
Figure 2:
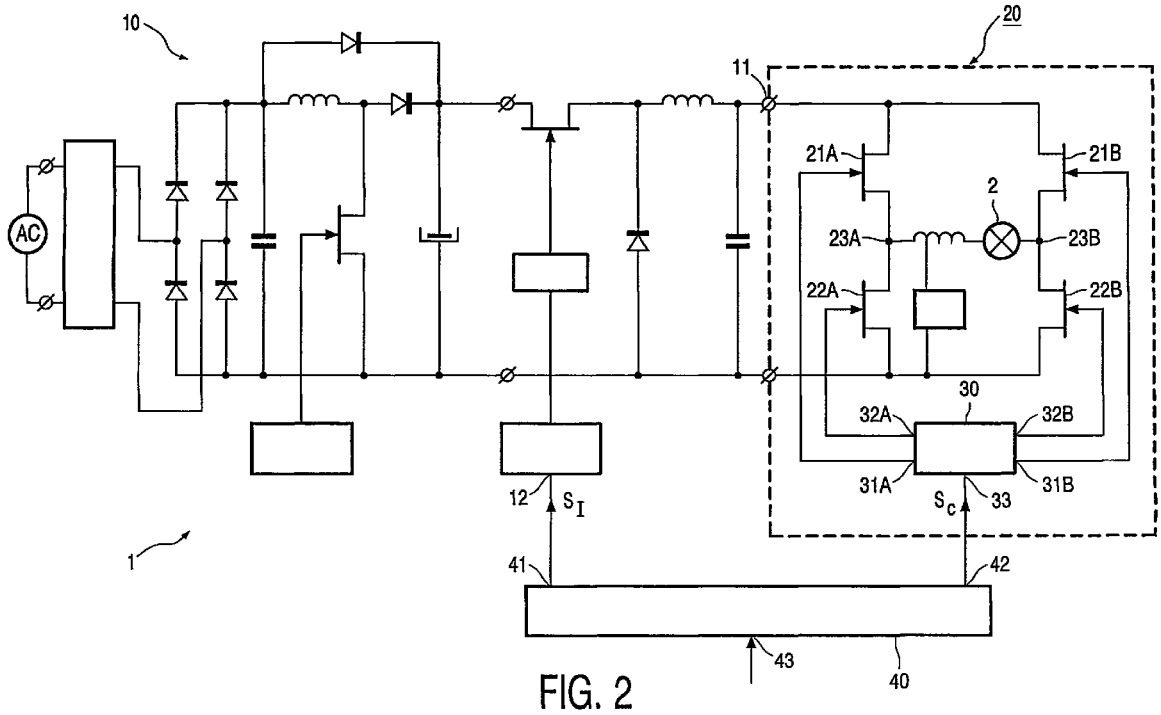
Figure 3A:
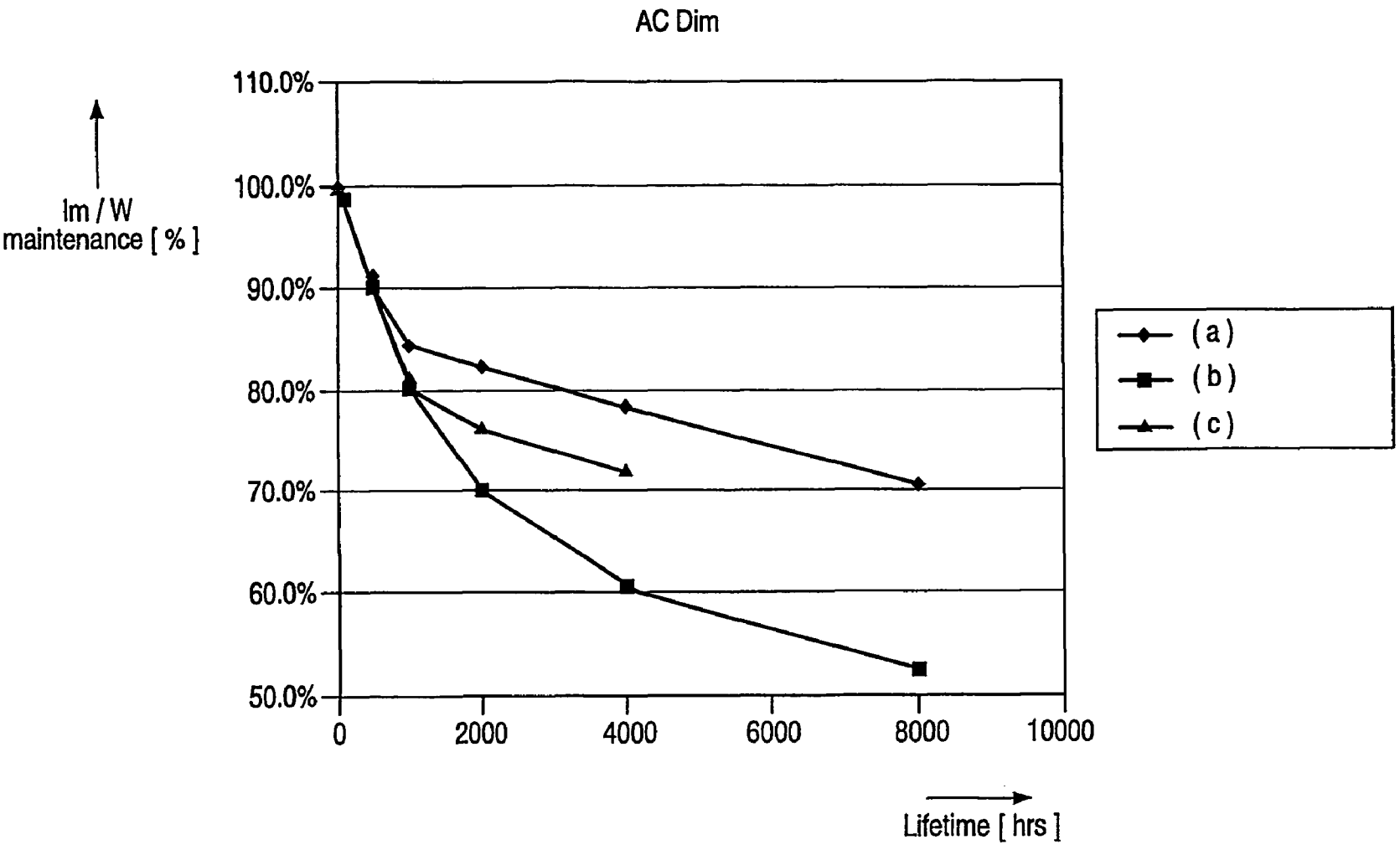
Figure 3B:
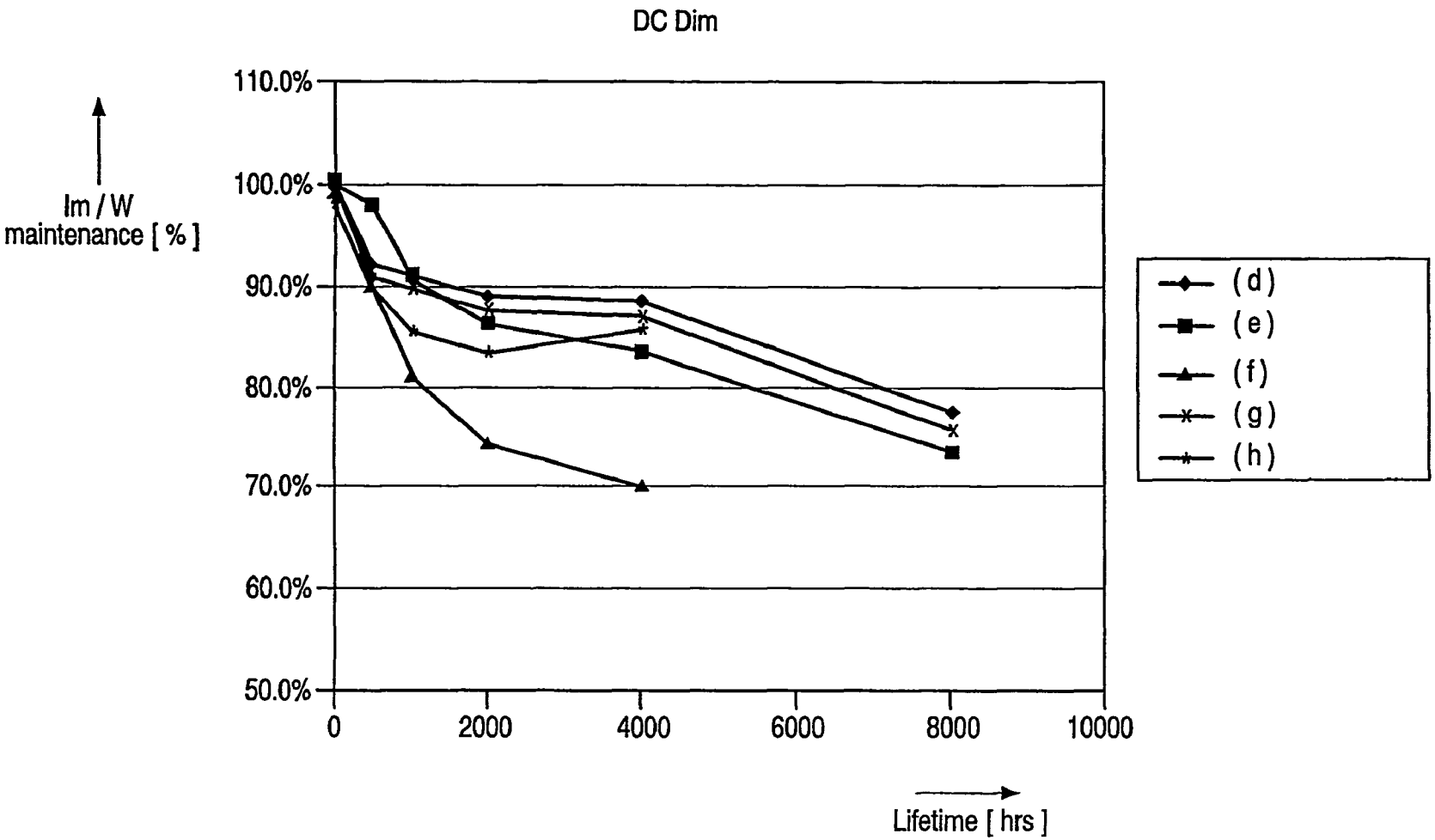

These and other aspects, features and advantages of the present invention will be further explained by the following description with reference to the drawings, in which:

FIGS. 1(*a*)-1(*c*) are graphs illustrating lamp current as a function of time;

FIG. 2 is a diagram illustrating an exemplary embodiment of a driving device for a lamp; and FIGS. 3A-B are graphs illustrating lamp maintenance as a function of lamp life.

FIGS. 1(*a*)-(*c*) are graphs illustrating the lamp current through a HID lamp as a function of time, for different dimming levels.

At FIG. 1(*a*), the current is shown for nominal operation of the lamp. It can be seen that the current magnitude or absolute value of the lamp current is always equal to $I_{nom}$, but that the lamp current changes direction at times $t_1$, $t_2$, $t_3$, etc., which is indicated as a change from $+I_{nom}$ to $-I_{nom}$ and vice versa. In this nominal mode of operation, the lamp power will be indicated as $P_{nom}$.

At FIG. 1(*b*), a dimmed mode of operation is illustrated, where the lamp is still supplied with square-wave current but the current magnitude or absolute value $I_L$ of the current is less than $I_{nom}$, which is expressed by the formula $I_L=\alpha I_{nom}$, where $\alpha<1$. The lamp power in this case is indicated as $P(\alpha)$, which is less than $P_{nom}$. According to the invention, a HID lamp is dimmed with such a square wave current having a current magnitude IL as long as $I_L/I_{nom}$ is larger than a predetermined value $\beta$. A suitable value for $\beta$ has been found to be approximately 60%, although in practice this will depend on the lamp type.

At FIG. 1(*c*), the DC mode of operation of the lamp is illustrated. Again, the magnitude $I_L$ of the lamp current can be expressed as $\alpha I_{nom}$, but now $\alpha$ is less than the above-mentioned predetermined value $\beta$.

First Experiment

A first test concerned a lamp of type CDM-T 70W/830, manufactured by Philips Corporation, which is a lamp having a nominal lamp current $I_{nom}$ of about 0.85 A and a nominal power of 70 W. The lamp was first operated with a square-wave current as described above and illustrated in FIG. 1 at (a) and (b). The magnitude of the current was reduced slowly, until the lamp went out. This was found to occur at a lamp power of about 35 W, corresponding to a dimming level of 50%, $\alpha$ being about 0.5 when the lamp went out.

By way of comparison, the lamp was operated in accordance with the method of dimming according to the present invention. Initially, the lamp was operated as illustrated in FIG. 1 at (a), at nominal power with nominal current. Then, as illustrated in FIG. 1 at (b), the current shape still being a square wave, the lamp current magnitude $I_L$ was reduced from $I_{nom}$ to $\alpha I_{nom}$, $\alpha$ being less than 1, until $\alpha=I_L/I_{nom}$ reached a predetermined value $\beta$, which was taken to be 60% in this experiment. Then, the commutation of the current was stopped, i.e. the current was changed to DC current, as illustrated in FIG. 1 at (c). Subsequently, the lamp current magnitude $I_L$ was reduced still further until the lamp went out. This was found to occur at a lamp power of about 20 W, corresponding to a dimming level of 30% of the nominal power, $\alpha$ being about 0.3 when the lamp went out.

Second Experiment

A second test concerned a lamp of type SDW-T 100W, manufactured by Philips Corporation, which is a lamp having a nominal lamp current $I_{nom}$ of about 1.1 A and a nominal power of 100 W. The same experiment as described above was performed. When operated with a square-wave current, the lamp went out at a lamp power of about 40 W, corresponding to a dimming level of 40% of nominal power, $\alpha$ being about 0.5 when the lamp went out.

When operated in accordance with the method of dimming according to the present invention, the lamp went out at a lamp power of about 10 W, corresponding to a dimming level of 10% of the nominal power, $\alpha$ being about 0.3 when the lamp went out.

Third Experiment

A third experiment concerned a lamp of type CDM-T 150W/830, manufactured by Philips Corporation, which is a lamp having a nominal lamp current $I_{nom}$ of about 1.7 A and a nominal power of 150 W. The same experiment as described above was performed. When operated with a square-wave current, the lamp went out at a lamp power of about 60 W, corresponding to a dimming level of 40% of the nominal power, $\alpha$ being about 0.4 when the lamp went out.

When operated in accordance with the method of dimming according to the present invention, the lamp went out at a lamp power of about 30 W, corresponding to a dimming level of 20% of the nominal power, $\alpha$ being about 0.2-0.3 when the lamp went out.

Thus, for all of these tested lamps, the minimum power level attainable has been reduced substantially by switching from square wave current to DC current.

It is noted that, although the exact value of $\beta$ for switching from square-wave current to DC current is not critical, this value should not be taken too high, because at current levels close to nominal current, a HID lamp should not be operated with DC current. As will be known to a person skilled in the art, the anode temperature is much higher during DC operation than during AC operation. During dimmed DC operation, the anode temperature should preferably not rise above the electrode temperature at nominal AC operation in order to avoid potentially detrimental effects.

It is known that the light generating capabilities of a lamp, expressed as light output per unit power, decreases as the lamp ages; this effect can be expressed as maintenance, i.e. how does a lamp maintain its original properties, by plotting the light generating capabilities versus the lamp life. Using the DC mode for dimming appears to also have an advantageous effect on the maintenance of a lamp, which is illustrated by FIGS. 3A-B. Here, maintenance is expressed as a percentage of the original light generating capabilities.

FIGS. 3A-B show the results of experiments conducted on lamps of type MHC070. Curves (a) to (c) of FIG. 3A relate to lamps driven with commutating current, whereas curves (d) to (h) of FIG. 3B relate to lamps driven with constant (non-commutating) current. All lamps were submitted to a cycle of 12 hours, which was repeated constantly.

Curve (a) relates to a cycle of 11 hours at nominal power, followed by 1 hour OFF. After 8000 hours, maintenance has decreased to about 70%.

Curve (b) relates to a cycle of 15 minutes at nominal power, followed by 10 hours 45 minutes burning at 60% of the nominal power, followed by 1 hour OFF. After 8000 hours, maintenance has decreased to almost 50%; a reduction to 70% is reached already after 2000 hours.

Curve (c) relates to a cycle of 5.5 hours at nominal power, followed by 5.5 hours burning at 60% of the nominal power, followed by 1 hour OFF. After 4000 hours, the maintenance has decreased to almost 70%.

It can be seen that maintenance is reduced as a lamp ages, while dimming causes the extent of the reduction to increase.

Curve (d) relates to a cycle of 11 hours at nominal power, followed by 1 hour OFF. After 8000 hours, maintenance has decreased to somewhat less than 80%.

Curve (e) relates to a cycle of 11 hours burning at 50% of the nominal power, followed by 1 hour OFF. After 8000 hours, maintenance is still above 70%.

Curve (f) relates to a cycle of 11 hours burning at 30% of the nominal power, followed by 1 hour OFF. After 4000 hours, the maintenance has decreased to somewhat less than 70%.

Curve (g) relates to a cycle of 5.5 hours at nominal power, followed by 5.5 hours burning at 50% of the nominal power, followed by 1 hour OFF. After 8000 hours, the maintenance is still about 75%.

Curve (h) relates to a cycle of 5.5 hours at nominal power, followed by 5.5 hours burning at 30% of the nominal power, followed by 1 hour OFF. After 4000 hours, the maintenance is still about 85%.

It follows that, even when a lamp is dimmed to a higher extent, the reduction in maintenance when using DC is less as compared to lamps burning on commutating current.

FIG. 2 schematically illustrates a possible embodiment of a driver 1 for driving a HID lamp 2 in accordance with the invention. Since such drivers are generally known, a detailed description of the design and operation of such drivers is not necessary here. A skilled person will recognize that such a driver 1 has a controllable current generating means 10, receiving an AC mains input voltage, and generating at an output 11 a DC current in response to a control signal $S_I$ received at a control input 12. This controllable current generating means 10 is followed by a commutator stage 20, which is shown in FIG. 2 in a full bridge embodiment. Such commutator stage 20 typically comprises four controllable switches 21A, 21B, 22A, 22B. A first pair of controllable switches 21A, 22A is arranged in series, a node 23A between these two switches being connected to one lamp electrode. A second pair of controllable switches 21B, 22B is likewise arranged in series, a node 23B between these two switches being connected to the other lamp electrode. A switch driver 30 has four outputs 31A, 31B, 32A, 32B connected to respective control inputs of said switches 21A, 21B, 22A, 22B. The switch driver 30 has two operative states. In a first operative state, the output signals at its four outputs 31A, 31B, 32A, 32B are such as to open switches 21A and 22B while closing switches 21B and 22A, corresponding to a lamp current flowing through the lamp 2 in one direction. In the other operative state, the output signals of the switch driver 30 are such as to open switches 211B and 22A while closing switches 21A and 22B, corresponding to lamp current flowing in the opposite direction. The switch driver has a control input 33; depending on the value of a signal $S_C$ received at its control input 33, the switch driver 30 either alternates between the first operative state and the second operative state (commutating mode) or the switch driver 30 is constantly in one of those two operative states (non-commutating mode). In other words, the control signal $S_C$ at the control input 33 of the switch driver 30 controls whether the lamp current is commutating or not. Hereinafter, this control signal $S_C$ will be assumed to be a digital signal having two possible values CM (commutating mode) and NCM (non-commutating mode).

According to the present invention, such a driver 1 is provided with a dim control unit 40 having one output 41 connected to the control input 12 of the controllable current generating means 10 for controlling the current level, and having a second output 42 for controlling the operation of the commutator stage 20. This second output 42 is connected to said control input 33 of the switch driver 30. The dim controller 40 has a user input 43 for receiving a user command, thus allowing a user to set a desired dim level.

In response to the setting of its user input 43, the dim controller 40 generates a corresponding control signal $S_I$ at its first output 41, for controlling the controllable current generating means 10 in order to generate a corresponding current level. If the desired current level is above a predetermined value β, the dim controller 40 generates, at its second output 42, an output signal $S_C$ having a first value CM. As long as the output signal $S_C$ at the second output 42 of the dim controller 40 has this first value CM, indicating a dim level between β and 1, the lamp current is commutating. If the desired current level is below said predetermined value β, the dim controller 40 generates, at its second output 42, an output signal $S_C$ having a second value NCM. As long as the output signal $S_C$ at the second output 42 of the dim controller 40 has this second value NCM, indicating a dim level below β, the lamp current has a constant direction.

Although the present invention has been explained in the foregoing by descriptions of a few exemplary embodiments, it should be clear to a person skilled in the art that the present invention is not limited to such embodiments; rather, various variations and modifications are possible within the scope of protection of the invention as defined in the appending claims.

For instance, it should be clear that inhibiting the commutation operation of the switch driver in a standard type commutator can be achieved in many ways, the embodiment depicted in FIG. 2 only illustrating one of the many possibilities of achieving this.

Furthermore, although the embodiment of FIG. 2 is depicted as a modular design, it is also possible that the dim controller 40, and even switch driver 30, are implemented as one integrated unit.

In the above, dimming has been described as decreasing the lamp current from the nominal lamp current to a lower current level. However, it will be clear to a person skilled in the art that, during dimmed operation, the dimming level can be increased as well as decreased. Increasing the dimming level involves increasing the lamp power and increasing the lamp current magnitude. So, the lamp current is increased as a DC current as long as $I_L/I_{nom}<\beta$, and the lamp current is increased as an alternating DC current as soon as $I_L/I_{nom}>\beta$.

The invention claimed is:

1. A method for operating a gas discharge lamp, said method comprising the acts of:

providing the lamp with a commutating DC current at a current level $I_L=\alpha I_{nom}$ for $\beta<\alpha\leqq 1$ for dimming the gas discharge lamp to a first dimming level, providing the lamp with a non-commutating DC current at a current level $I_L=\alpha I_{nom}$ for $\alpha\leqq\beta$ for dimming the gas discharge lamp to a second dimming level which is below the first dimming level, wherein $I_L$ represents the actual lamp current;

$I_{nom}$ represents the nominal lamp current;

and β is a predetermined value less than 1.

2. The method according to claim 1, wherein β is approximately equal to 0.6.

3. A method for dimming a gas discharge lamp, the method comprising the acts of:

operating the lamp at nominal power with commutating DC current having a current magnitude $I_L=\alpha I_{nom}$, α being equal to 1 or less than 1;

reducing the current magnitude $I_L$ but still operating the lamp at commutating DC current, until a reaches a predetermined value β;

providing the lamp with DC current of current magnitude $I_L=\alpha I_{nom}$ when $\alpha$ has reached the value $\beta$;

and further reducing the current magnitude, but still providing the lamp with DC current.

4. The method according to claim 3, wherein $\beta$ is approximately equal to 0.6.

5. A driver comprising:

controllable current generating means for generating a substantially constant current;

and controllable commutating means designed to commutate said current if the current magnitude exceeds a predetermined current level and to output said current as a non-commutating DC current if the current magnitude is below the predetermined current level.

6. A driver comprising:

a current generator configured to provide a DC current;

commutating means configured to commutate the DC current to provide commutating DC current in a commutating mode;

a control unit having a first control output for generating a control signal controlling current magnitude of the current generator, and a second control output for generating a control signal controlling the commutating means, wherein the control unit is adapted to switch the commutating means to the commutating mode if the current magnitude is larger than a predetermined current level, and to switch the commutating means to a DC mode if the current magnitude is below said predetermined current level.

7. A method for operating a gas discharge lamp, said method comprising the acts of:

substantially powering the lamp with commutating DC current for normal operation; and substantially powering the lamp with non-commutating DC current during dimming.

* * * * *